United States Patent [19]

Rivkin

[11] Patent Number: 4,688,792

[45] Date of Patent: Aug. 25, 1987

[54] TRAINING AND EXERCISING MACHINE FOR FOOTBALL AND WRESTLING

[76] Inventor: Efim Rivkin, 1107 Pomeroy Rd., Santa Clara, Calif. 95051

[21] Appl. No.: 870,801

[22] Filed: Jun. 5, 1986

[51] Int. Cl.[4] ..... A63B 69/00

[52] U.S. Cl. ..... 272/76; 273/55 A; 273/55 R

[58] Field of Search ..... 272/76, 77, 78, 118, 272/123, 93, 117, 134, 116, 128, 135, 141, 142, 61, 62, 109, 144; 273/55 A, 55 R; 446/336, 360, 322

[56] References Cited

U.S. PATENT DOCUMENTS

| | | | |
|---|---|---|---|
| 1,329,623 | 2/1920 | Meurer | 446/322 |
| 1,547,268 | 7/1925 | Sotomayor | 272/118 |
| 2,940,757 | 6/1960 | Britt | 273/55 R |
| 3,524,644 | 8/1970 | Kane | 272/62 |
| 3,581,739 | 6/1971 | Brandt et al. | 272/146 |
| 3,640,529 | 2/1972 | Kane | 272/62 X |
| 3,658,332 | 4/1972 | Adduci et al. | 273/55 A X |
| 3,866,914 | 2/1975 | Jackson | 273/55 R X |
| 3,888,481 | 6/1975 | Adams, Jr. et al. | 272/83 R |

*Primary Examiner*—Richard J. Apley
*Assistant Examiner*—H. Flaxman
*Attorney, Agent, or Firm*—David Pressman

[57] ABSTRACT

A machine for training football players and wrestlers comprises a rigid U-shaped support frame (12*a,* 12*b,* 14) which supports vertical struts (22*a,* 22*b*). A crossbeam carrying a dummy (39) slides either in vertical guides (24*a,* 24*b*) or in inclined guides (26*a,* 26*b*) which have switchable cams. These cams are joined to both guides so that one of them is open when the other is closed. The upper ends of the guides have measuring device for registration of forces applied by the athlete to the dummy. By opening or closing respective guides, it is possible to use the machine for various moves, thereby developing in the athlete rapid dynamic reflexes.

14 Claims, 3 Drawing Figures

TRAINING AND EXERCISING MACHINE FOR FOOTBALL AND WRESTLING

BACKGROUND

1. Field of the Invention

This invention relates to sports, particularly to a teaching and exercising machine for football players and wrestlers.

2. Description of the Prior Art

Development of rapid dynamic reflexes in athletes is very important for such athletes to achieve optimum skills and performance. The use of exercising machines has been found to be very useful to develop such reflexes since such machines provide a full spectrum of stimuli and uniform training conditions. Also, machines are far less dangerous than human contact when practicing.

Known in the art is a device for training wrestlers (U.S. Pat. No. 3,888,481 to Adams, Jr., et al., 1975 June 10). This device includes a padded dummy-like figure formed over a frame of which the arms and upper torso are spring-biased to a certain position, but which are moveable to other positions. This device can be resiliently mounted to a wall or a mounting framework.

This device, however, does not provide sufficient freedom of motion of the dummy to simulate the full contact condidtions of practice which are usually associated with lifting of an opponent in wrestling.

Even more important, this and other prior-art machines do not generate any stimuli for developing dynamic reflexes; thus they are essentially exercising machines, rather than training machines. Also they cannot be used to develop automatic motions, a very important ability in live conditions of wrestling or football.

Another disadvantage of prior-art machines is that they are useful only to train wrestlers and cannot be used to train football players.

OBJECTS AND ADVANTAGES

Accordingly, one object of the present invention to provide a machine for training and exercising wrestlers and football players in particular moves. Another object is to train athletes to develop automatic movements for particular moves, to eliminate any danger of injury in practice, to develop a special group of muscles for particular moves, and to develop the ability to lift a dummy and to simulate full contact. Other objects and advantages will be understood by reference to the ensuing desciprtion of the invention and the accompanying drawings.

ACCOMPANYING DRAWINGS

DESCRIPTION OF MACHINE

Figure 1:
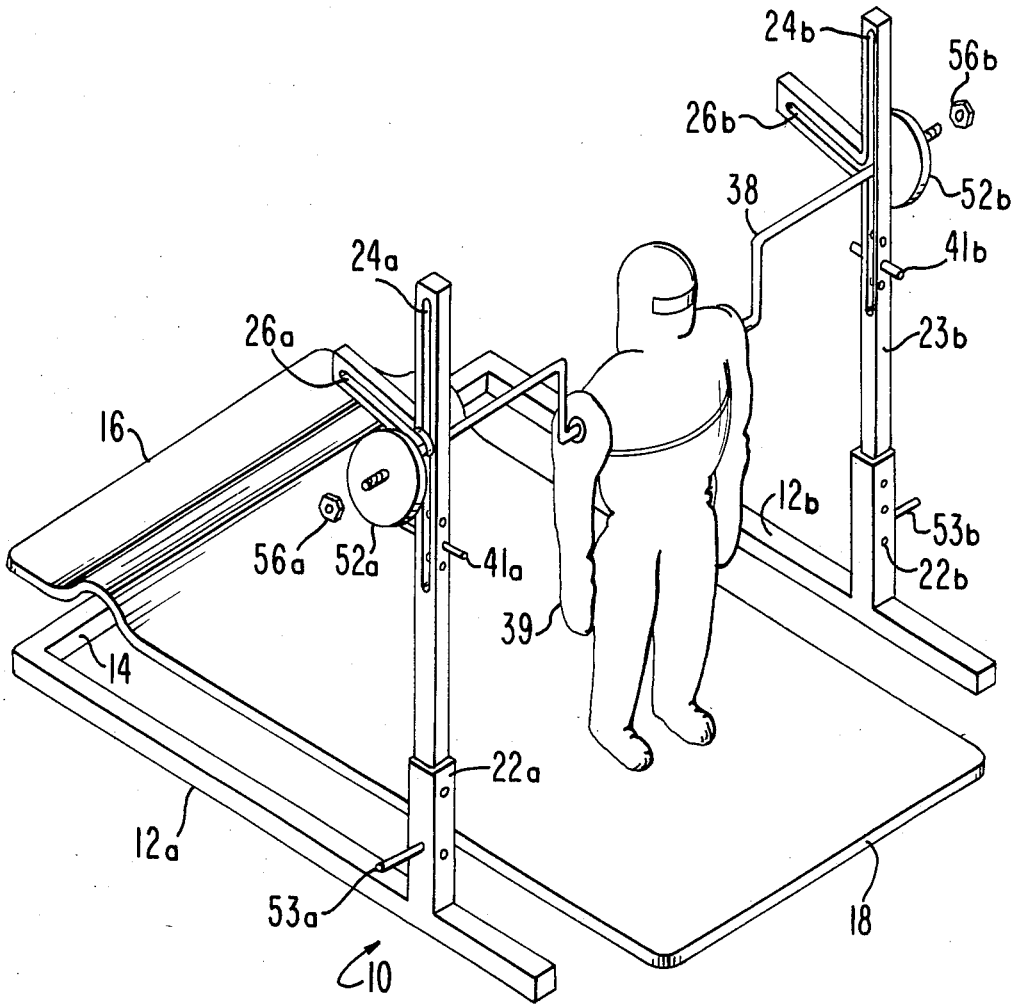
FIG. 1 is a general perspective view of the training and exercising machine of the invention.

As shown in FIG. 1, the training and exercising machine of the invention consists of a rigid floor frame 10. Frame 10 is formed of two parallel horizontal members 12*a* and 12*b* interconnected at their rear ends by a cross member 14. These three members can be interconnected by welding, fasteners, or any other suitable means known in the art.

The frame may be covered by a slanted deck 16 which hides member 14 and has a front edge 18 which merges with the surface of the floor in order to protect athletes from stumbling during training. Deck 16 is inclined upwardly from front to rear from edge 16 to and over above member 14. Deck 16 is narrower than the width between parallel mmbers 12*a* and 12*b* so that these members are not covered by the deck.

Figures 2, 3:
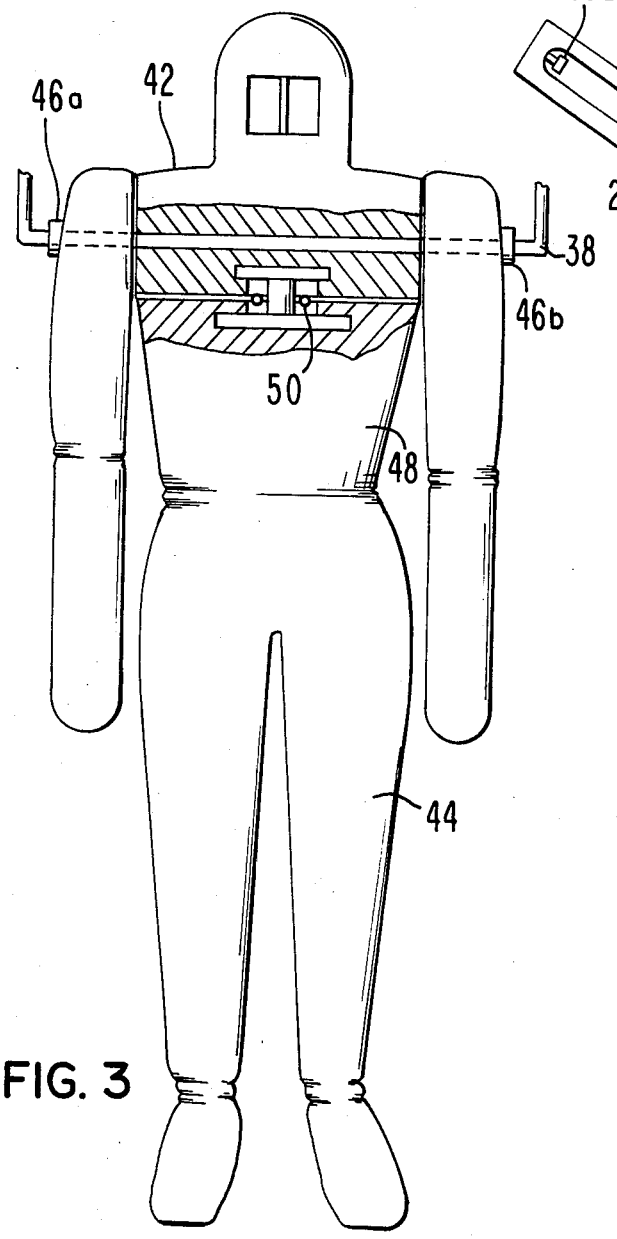
FIG. 2 is a partial sectional side view of the machine of FIG. 1.
FIG. 3 is a paartial sectional view of a dummy used in the machine.

As shown in FIG. 2, wheels 20*a*, 20*b*, 22*a* and 22*b* are attached to the floor frame. The wheels can be moved from a working position for transportation (shown by broken lines in FIG. 2) to a storage position (shown by solid lines in FIG. 2) in which they are usually kept during the use of the machine.

Attached to front ends of floor frame members 12*a* and 12*b* are hollow vertical strut bases 22*a* and 22*b*, respectively. These strut bases can be permanently fixed to the frame or can be removably attached thereto by known means, e.g., by bolts (not shown in the drawings). Strut bases 22*a* and 22*b* may have a square cross section. Inserted into strut bases 22*a* and 22*b* are inner struts 23*a* and 23*b* which are adjustably movable within strut bases. The inner struts can be fixed in any vertical position (depending on the height of the athlete) by means of bolts 34*a* and 34*b* which are inserted into respective holes 35*a* and 35*b* in the strut bases.

Struts 23*a* and 23*b* have through vertical guide slots 24*a* and 24*b* (FIGS. 1 and 2) and inclined guides 26*a* and 26*b* merging with the vertical guides for a purpose explained later. The inclined guides preferably are positioned at an angle of about 45° to the vertical guides, but this angle may be within a range of 15° to 85°. Since both struts, their guides, and other elements are identical, only one of them is shown in a cross-sectional view and corresponding elements of the another strut are designated by the same reference numerals but with an addition of the suffix "b").

As shown in FIG. 2, the vertical guides also contain supports 37*a* and 37*b* with through holes 39*a* and 39*b*. Bolts 41*a* and 41*b* are inserted into holes 39*a* and 39*b*, thereby locking the supports in inner struts 23*a* and 23*b*. Compression springs 36*a* and 36*b* rest on supports 35*a* and 35*b* and in turn support a crossbeam 38 which is guided in vertical guides 24*a* and 24*b*. Crossbeam 38 comprises a rigid member which has two horizontal end portions in slots 24*a* and 24*b*, respectively, two vertical portions which extend down from the inner ends of the end portions, and a central horizontal portion which connects the lower ends of the vertical portions. Suspended on the central horizontal portion of crossbeam 38 is a dummy 39 (FIG. 1), the structure of which is described in detail later.

The inner struts contain cam elements 40*a* and 40*b* (FIG. 2) which are switchable so that they close access either to inclined guides 26*a* and 26*b* or to the upper parts of guides 24*a* and 24*b* which are located above merging points between both guides. For switching, the cams are pivotally attached to struts 23*a* and 23*b* by means of pins 49*a* and 49*b*. Holes 43*a* and 43*b*, together with holes 45*a* and 45*b*, are formed in strut bases 22*a*, 22*b* for locking the cams in the position shown by a solid line in FIG. 2. This enables beam 38 to be guided into inclined guides 26*a*, 26*b* or held in the position shown in FIG. 2. The cams are locked by bolts 47*a* and 47*b*.

Thus when crossbeam 38 is pused up with the cam elements closing access to inclined guides 26*a* and 26*b*, the crossbeam enters the upper parts of vertical guides 24*a* and 24*b*. When the upper parts of guides 24*a* and 24*b* are closed, the crossbeam will enter the inclined guides.

As will be shown later, the last-mentioned motion is used in training for a particular move (initial contact of the tackle) and is facilitated when the athlete pushes dummy 39 upwardly and rearwardly.

Dummy 39 can be made in the form of a human body and can be padded with a suitable soft material, as known in the art. Dummy 39 consists essentially of two parts: an upper part 42 which corresponds to the part of the human body above the waist, and a lower part 44 which is the part below the waist. Preferably dummy 39 is constructed to weight about 55 kg, in proportion to the proportional weights of the human body.

FIG. 3 shows the inner arrangement of the dummy and illustrates the interconnection between both parts. More specifically, upper part 42 of the dummy freely rotates on crossbeam 38. Movement of the dummy in the axial direction of the cross beam is restricted by stop rings 46*a* and 46*b*.

Extending downwardly from upper part 42 is a shaft 48 which rotatably supports lower part 44 on a thrust bearing 50 so that lower part 44 can rotate on shaft 48, i.e., about a vertical axis. At the same time the lower part can rotate around a horizontal axis (which is in fact is a crossbeam) together with upper part 42.

Since crossbeam 38 can move vertically in guides 24*a* and 24*b*, or at an angle to the vertical direction in inclined guides 26*a* and 26*b*, dummy 39 can be pushed horizontally and lifted, i.e., it can simulate full contact conditions.

In order further to approach full contact conditions, the dummy is loaded by weights 52*a* and 52*b* (FIG. 1) which are attached to ends of crossbeam 38 projecting beyond vertical strut bases 22*a* and 22*b*. The weights are fixed on the ends of the crossbeam by any suitable means, i.e., by nuts 56*a* and 56*b*. The load on the dummy can be adjusted by selecting different sets of weigths 52*a* and 52*b*, from zero kg up to about 90 kg for the combined weight of both sets. Projections 53*a* and 53*b* can be attached to the outer side walls of outer struts 2*a* and 22*b*, for storage of weights like 52*a* and 52*b*.

In order to measure the force with which the athlete tackles the dummy, the apparatus can be provied with force measuring cells 60*a* and 60*b* (FIG. 2) installed at upper ends of the vertical and inclined guides, respectively. The structure of the load cells and suitable readouts therefor are known and do not require specific description.

The moving parts, especially the guides, preferably are made of cold rolled or case hardened steel with sufficient thickness and rigidity to handle repeated, continuous use by rugged athletes. The working surfaces of the guides and other moving parts are smooth and are lubricated with very viscous grease. The crossbeam contains flanges (not shown) to keep it in a fixed horizontal position and its end portions (which move in the guides) may have rollers thereat to reduce friction and noise.

OPERATION OF APPARATUS

The training and exercising machine can be used by football players and wrestlers to practice many moves and holds. However only three major moves will be described; these will be sufficient to understand the main principles of the machine.

The first move advantageous for practicing wrestlers is known as "Double Leg Lifting". For practicing this move, switchable cam elements 40*a* and 40*b* are switched into the position in which inclined guides 26*a* and 26*b* are closed (position shown by the broken line in FIG. 2) and vertical guides 24*a* and 24*b* are open. The athlete goes down on one knee, grabs hold of the dummy by wrapping his or her arms around the dummy, and lifts the dummy by standing. The lift of dummy 39 causes upward movement of crossbeam 38, together with weigths 26*a* and 26*b*, until the crossbeam contacts load-measuring cells 60*a* and 60*b* which register the force applied to the dummy. The move is completed by the athlete releasing whereupon it returns to its initial position, its fall cushioned by springs 36*a* and 36*b* on which it rests after use.

In this exericse the machine eliminates common mistakes by making it impossible for the athlete to push in any other direction but up.

The next move which can be practiced on the machine is called the "Fireman's Carry". For this move, switchable cam elements 40*a* and 40*b* are in the same position as described above. The athlete goes down on one knee, grabs one of the dummy's arms with one hand with his shoulders and head against the dummy's body, and his other arm between the dummy's legs. The athlete then stands while pushing forward and up. This raises the dummy's feet backward and lifts the dummy. The athlete follows through as described above under "double leg lifting". This move eliminates any tendency for the athlete to fall back.

The third exemplary move, intended for football, is "The Tackle". The athlete runs to and plows or drives against the dummy, simultaneously wrapping his or her arms around the dummy, lifting the dummy off its feet, and continuing to drive up at a 45° angle.

For practicing this move, switchable cam elements 40*a* and 40*b* are switched to the position shown by the solid line in FIG. 2 by removing bolts 47*a* and 47*b* from holes 45*a* and 45*b*, turning cam elements 40*a* and 40*b* into their inclined position, and then inserting the bolts into cam elements 40*a* and 40*b* and into holes 43*a* and 43*b*. In this position the cam elements close upper parts of vertical guides 24*a* and 24*b* and open inclined guides 26*a* and 26*b*.

At the moment of contact of the athlete with dummy 39, crossbeam 38 (loaded with dummy 39 and weigths 55*a* and 55*b*) is directed into inclined guides 26*a* and 26*b* and moves until it contacts load cells 60*a* and 60*b* which register the applied force.

The move is completed by turning the dummy upwardly rearwardly around cross-beam 38 with the athlete continuing to run under the dummy. Thereafter dummy 39 returns to its initial position by gravity.

In all moves described above, rotation of lower part 44 of cummy 39 with respect to upper part 42 of dummy 39 imitates conditions of full human contact, prevents trauma, creates variable positions of the dummy's members, and different positions for grabs.

CONCLUSION, RAMIFICATIONS, AND SCOPE

Thus readers will see that a highly valuable, yet simple exercise machine has been provided which can simulate many full contact conditions in football or wrestling while training the athlete properly and minimizing the chance of injuries. The athlete is trained with a simulated opponent to develop the athlet's dynamic reflexes. The load can be adjusted with the side weights and the force applied by the athlete can be conveniently measured.

While the invention has been described with reference to particular preferred embodiment, readers will understand, however, that many other modifications and applications of the machine are possible without departure from the main principle of the invention. For example, the crossbeam may have a straight horizontal form. Telescopic inner struts 23*a* and 23*b* can be eliminated and the cross-beam can be inserted directly into stationary strut bases 22*a* and 22*b* with the use of adjustable supports within the struts. Thus the scope of the invention should be determined, not by the examples given but by the appended claims and their legal equivalents.

I claim:

1. An apparatus for physical training, comprising:

a supporting frame;

vertical guide means supported by said frame;

at least one inclined guide means merging with said vertical guide means;

a horizontal crossbeam element positioned for movement in said vertical and said inclined guide means;

means for selectively guiding said horizontal crossbeam into either of said horizontal or said inclined guide means;

a dummy attached to and capable of rotating about said horizontal crossbeam element;

loading means attached to said crossbeam element for adding weight to said dummy.

2. The apparatus of claim 1 wherein said frame comprises a U-shaped supporting element and vertical struts are attached to the legs of said U-shaped supporting element, said vertical and inclined guides being formed in said vertical struts, said inclined guides being branched upwardly and rearwardly from said vertical guides so that said crossbeam element can freely enter said inclined guide from said vertical guide.

3. The apparatus of claim 2 wherein said selective guide means includes means for selectively closing either (a) the part of said vertical guide which is located above said inclined guide, or (b) said inclined part.

4. The apparatus of claim 2, further including lower supporting means adjustably located in said vertical guide and upper indicating means at upper ends of said vertical and inclined guides for indicating the force applied to said dummy.

5. The apparatus of claim 4 wherein said lower supporting means support means comprises resilient means which supports said crossbeam element.

6. The apparatus of claim 2 wherein said inclined guide means is positioned at an angle within the range of 15° to 85° to said vertical guide means.

7. The apparatus of claim 1 wherein said dummy is shaped like a human being and consists of an upper part rotatable about said horizontal crossbeam element and a lower part rotatable on a vertical axis with respect to said upper part.

8. The apparatus of claim 1 wherein the ends of said crossbeam element extend outwardly beyond said frame and said loading means comprises a set of disks fitted on said extending ends.

9. An appartus for training football players and wrestlers comprising:

a support frame;

a pair of stationary vertical columns rigidly atttached to said support frame and having vertical guides;

a pair of struts telescopically inserted into said vertical guides and having means for locking said struts in said vertical guides;

each of said struts having vertical guide means;

a pair of inclined guide means extending rearwardly and upwardly from said vertical guide means;

a horizontal crossbeam guided to move in said vertical and said inclined guide means;

means for selectively opening said inclined guide means and closing the part of said vertical guide means located above its point of merging with said inclined guide means, or for closing said inclined guide means and opening said part of said vertical guide means;

a dummy capable of rotating about said horizontal crossbeam element; and loading means attached to said horizontal crossbeam element for adding weight to said dummy.

10. The apparatus of claim 9, further including lower supporting means adjustably located in said vertical guide means and upper indicating means at upper ends of said vertical and inclined guides for indicating the force applied to said dummy.

11. The apparatus of claim 10 wherein said lower supporting means comprises resilient means which supports said crossbeam.

12. The apparatus of claim 9 wherein said inclined guide means is positioned with respect to said vertical guide means at an angle within the range of 15° to 85°.

13. The apparatus of claim 9 wherein said dummy is shaped like a human being and consists of an upper part rotatable about said horizontal crossbeam, and a lower part rotatable on a vertical axis with respect to said upper part.

14. The apparatus of claim 9 wherein the ends of said crossbeam extend outwardly beyond said frame, and said said loading means comprise a set of disks fitted on said extending ends.

* * * * *